US008341764B1

(12) United States Patent
Wilson

(10) Patent No.: US 8,341,764 B1
(45) **Date of Patent: *Jan. 1, 2013**

(54) CALF PROTECTOR FOR ROWERS

(76) Inventor: Alfred Wendell Wilson, Manassas, VA (US)

( * ) Notice: Subject to any disclaimer, the term of this patent is extended or adjusted under 35 U.S.C. 154(b) by 144 days.

This patent is subject to a terminal disclaimer.

(21) Appl. No.: 12/781,786

(22) Filed: May 17, 2010

Related U.S. Application Data

(63) Continuation-in-part of application No. 12/110,162, filed on Apr. 25, 2008, now Pat. No. 7,752,678.

(51) Int. Cl.
*A41D 13/00* (2006.01)

(52) U.S. Cl. ..... 2/22

(58) Field of Classification Search ..... 2/16, 22, 2/24, 62, 338; 128/878, 881, 892; 602/20, 602/26, 61, 62

See application file for complete search history.

(56) References Cited

U.S. PATENT DOCUMENTS

| | | | |
|---|---|---|---|
| 1,610,378 | A | 12/1926 | Hogan |
| 2,075,760 | A | 3/1937 | Hesse |
| 3,268,912 | A | 8/1966 | Whelan |
| 3,506,000 | A | 4/1970 | Baker |
| 3,508,544 | A | 4/1970 | Moore et al. |
| 3,926,186 | A | 12/1975 | Nirschl |
| 3,942,525 | A | 3/1976 | Dragan |
| 4,334,528 | A | 6/1982 | Gauvry |
| 4,384,583 | A | 5/1983 | Speelman et al. |
| 4,433,682 | A | 2/1984 | Badra |
| 4,966,134 | A | 10/1990 | Brewer |
| 5,417,647 | A | 5/1995 | Down |
| 5,520,628 | A | 5/1996 | Wehr |
| 5,865,782 | A | 2/1999 | Fareed |
| 6,032,286 | A | 3/2000 | Thomas et al. |
| 6,311,337 | B1 | 11/2001 | Tollini |
| 6,852,088 | B2 | 2/2005 | Gaylord |
| D503,806 | S | 4/2005 | Williams |
| 7,752,678 | B1 * | 7/2010 | Wilson ..... 2/22 |

FOREIGN PATENT DOCUMENTS

| | | |
|---|---|---|
| GB | 2 068 710 | 8/1981 |

* cited by examiner

*Primary Examiner* — Tejash Patel

(74) *Attorney, Agent, or Firm* — Swift & Swift; Stephen Christopher Swift

(57) ABSTRACT

A calf protector for rowers, comprising a single strip of neoprene (or a similar synthetic or natural rubber) covered by nylon (or other fabric having loops) with a strip of hook fasteners (as in VELCRO®) on one end. The neoprene strip is wider in the main middle part, and narrower at the ends. Hook fasteners on the inside surface at one end of the strip can engage loops in the fabric on the outside surface at the opposite end of the strip (or visa versa) so that it forms a loop around the rower's leg, to protect the back of the leg from friction against the front ends of rails on which the seats in a boat move when rowing. The invention may also be used by other persons to protect their legs and/or arms. The invention encompasses both an apparatus and a method for protecting limbs using the apparatus.

5 Claims, 7 Drawing Sheets

CALF PROTECTOR FOR ROWERS

CROSS REFERENCE TO RELATED APPLICATION

This application is a Continuation-in-Part of U.S. Regular Utility patent application Ser. No. 12/110,162, filed Apr. 25, 2008, which is incorporated herein by reference.

BACKGROUND OF THE INVENTION

1. Field of the Invention

The present invention relates to apparatus and methods for protecting the limbs of athletes from damage due to friction or collision.

2. Description of the Prior Art

There have been numerous prior inventions of devices for protecting the limbs of athletes or other persons, but none that are equivalent to the present invention.

U.S. Pat. No. 1,610,378, issued on Dec. 14, 1926, to George Francis Hogan, discloses an ankle protector, that is fastened with cords, rather than hook fasteners and fabric loops as in the instant invention.

U.S. Pat. No. 2,075,760, issued on Mar. 30, 1937, to Richard Hesse, discloses an ankle protector that is held in place by a strap going under the foot, rather than by hook fasteners and fabric loops as in the instant invention.

U.S. Pat. No. 3,268,912, issued on Aug. 30, 1966, to Clifford H. Whelan, discloses an ankle protector for bowlers, which is secured by snap fasteners, rather than by hook fasteners and fabric loops as in the instant invention.

U.S. Pat. No. 3,506,000, issued on Apr. 14, 1970, to Jack R. Baker, discloses an ankle support having a pair of straps with hook and loop fasteners, rather than a single strap as in the instant invention.

U.S. Pat. No. 3,508,544, issued on Apr. 28, 1970, to Francis C. Moore and Leon R. Perkinson, discloses a heel guard for bedfast persons, having an oval central body from which multiple straps extend. The instant invention is distinguishable, in that it has only a single strap.

U.S. Pat. No. 3,926,186, issued on Dec. 16, 1975, to Robert P. Nirschl, discloses a muscular support comprising a pad fastened with straps having hook and loop fasteners to secure it around the leg of a user. The pad has a curvilinear top edge. The instant invention is distinguishable, in that its central portion has straight edges.

U.S. Pat. No. 3,942,525, issued on Mar. 9, 1976, to William B. Dragan, discloses an athletic wrap having hook and loop fasteners, and a laterally extending tongue that the instant invention lacks.

U.S. Pat. No. 4,334,528, issued on Jan. 15, 1982, to George R. Gauvry, discloses a strap for protecting knees, rather than protecting calfs as in the instant invention.

U.S. Pat. No. 4,433,682, issued on Feb. 28, 1984, to Sami A. Badra, discloses an ankle protector, having a pair of straps with hook and loop fasteners. The instant invention is distinguishable, in that it has only a single strap.

U.S. Pat. No. 4,384,583, issued on May 24, 1983, to Irving A. Speelman and James R. Hannah, discloses a tourniquet, rather than a calf protector as in the instant invention.

U.S. Pat. No. 4,966,134, issued on Oct. 30, 1990, to Jeffrey L. Brewer, discloses an ankle protector, comprising a pair of supports, each including a hard exterior shell that the instant invention does not require.

U.S. Pat. No. 5,417,647, issued on May 23, 1995, to James W. Down, discloses a device for providing support behind the knee joint, rather than a calf protector as in the instant invention.

U.S. Pat. No. 5,520,628, issued on May 28, 1996, to Maxon P. Wehr, discloses an ankle brace with custom fitting that the instant invention does not require.

U.S. Pat. No. 5,865,782, issued on Feb. 2, 1999, to Donald O. Fareed, discloses a knee compression band, rather than a calf protector as in the instant invention.

U.S. Pat. No. 6,032,286, issued on Mar. 7, 2000, to Angela P. Thomas and Theresa Conner, discloses an inner ankle protector device, with an outer shell that the instant invention does not require.

U.S. Pat. No. 6,311,337, issued on Nov. 6, 2001, to Michael D. Tollini, discloses a fastener for a shin guard, with multiple bands that the instant invention does not require.

U.S. Pat. No. 6,852,088, issued on Feb. 8, 2005, to Eric Lee Gaylord, discloses a knee support device for applying radial pressure, rather than a calf protector as in the instant invention.

U.S. Pat. No. D503,806, issued on Apr. 5, 2005, to Mike Williams, discloses a knee strap, rather than a calf protector as in the instant invention.

British Patent No. 2 068 710, published on Aug. 19, 1991, inventor Aldo Rafael Cassettari, discloses an ankle guard, with a strap that passes under the foot that is not required in the instant invention.

None of the above inventions and patents, taken either singly or in combination, is seen to describe the instant invention as claimed.

SUMMARY OF THE INVENTION

The present invention is a calf protector for rowers, comprising a single strip of neoprene (or a similar synthetic or natural rubber) covered by a fabric (such as nylon) with a strip of hook fasteners (as in VELCRO®) on one end that can engage loops on the fabric covering. The neoprene strip is wider in the main middle part, and narrower at the ends with the strips of hook and loop fasteners. Hook fasteners on the inside surface at one end of the strip can engage loops in the fabric on the outside surface at the opposite end of the strip (or visa versa) so that it forms a loop around the rower's leg, to protect the back of the leg from friction against the front ends of rails on which the seats in a boat move when rowing.

Accordingly, it is a principal object of the invention to provide an apparatus to protect the calves of the legs of rowers from injury due to friction.

It is another object of the invention to provide a method for protecting the calves of the legs of rowers from injury due to friction.

It is a further object of the invention to provide an apparatus to protect the limbs of any person from injury.

Still another object of the invention is to provide a method for protecting the limbs of any person from injury.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is an apparatus and method for protecting the limbs of its wearers, specifically designed for protecting the calves of rowers.

Figure 1:
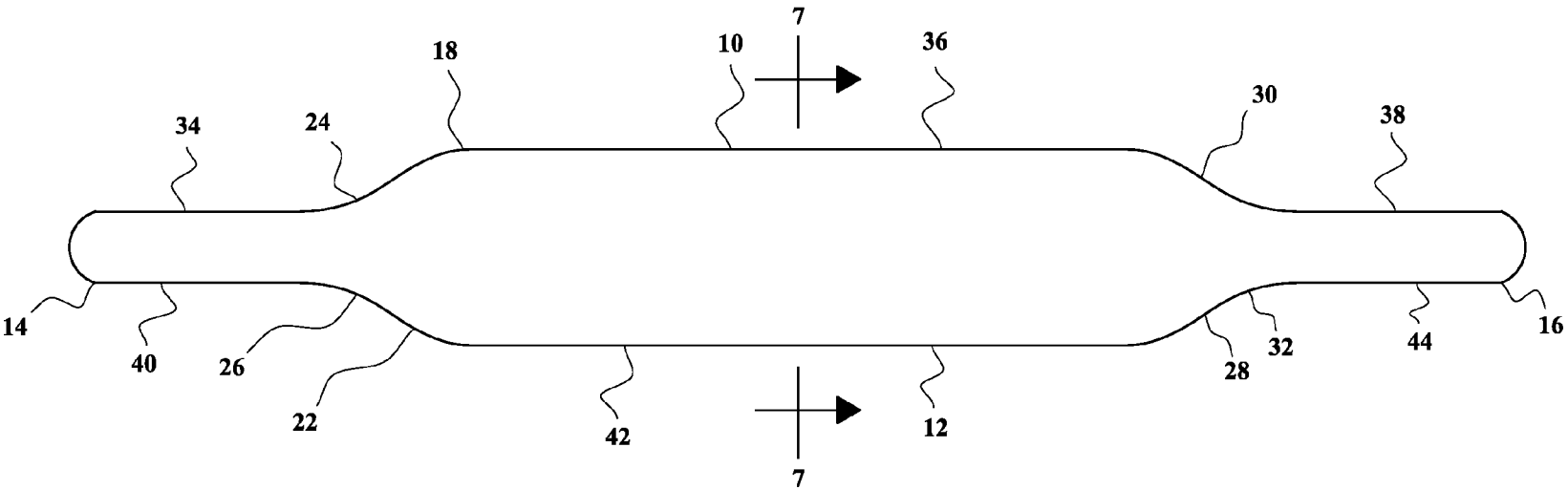
FIG. 1 is a front elevational view of the preferred embodiment of the invention in an open position.

FIG. 1 is a front elevational view of the preferred embodiment of the invention in an open position, comprising a single elongated strip 10 made of a flexible material covered by a fabric, having an elongated wide middle section 12, a narrow first end section 14 and a narrow second end section 16 on opposite sides of the middle section. The inner surface 18 of the middle and end sections is visible in FIG. 1. There is a curved tapering portion 22 between the first end section and the middle section, with an upper edge 24 and a lower edge 26, and a curved tapering portion 28 between the middle section and the second end section, with an upper edge 30 and a lower edge 32. The middle and end sections have parallel straight upper edges 34, 36 and 38 and straight lower edges 40, 42 and 44. The two curved tapering portions are symmetrical with each other, and their upper and lower edges are symmetrical.

Figure 2:
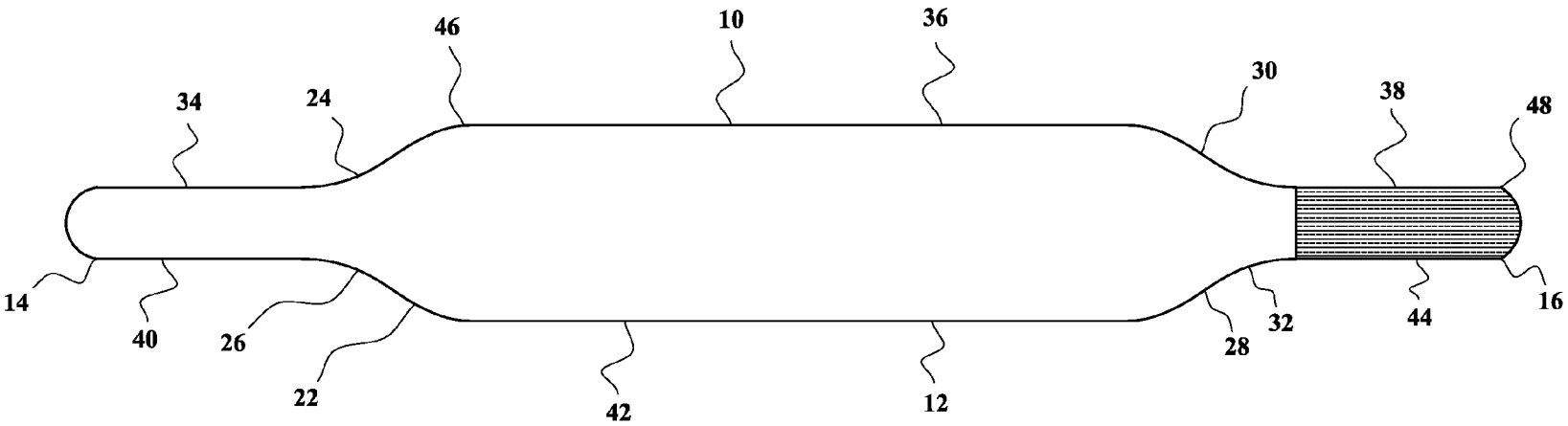
FIG. 2 is a rear elevational view of the preferred embodiment of the invention in an open position.
Figure 3:
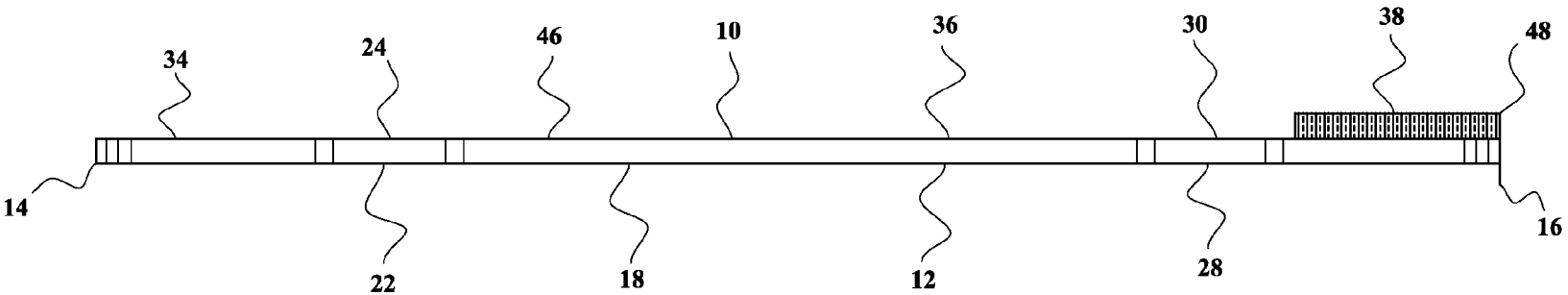
FIG. 3 is a top view of the preferred embodiment of the invention in an open position.

FIG. 2 is a rear elevational view of the preferred embodiment of the invention in an open position (produced by rotating FIG. 1 one hundred eighty degrees on a horizontal axis), showing the outer surface 46 of the middle and end sections, and hook fasteners 48 on the outer surface of the second end section. FIG. 3 is a top view of the preferred embodiment of the invention in an open position, with the bottom view being symmetrical.

Figure 4:
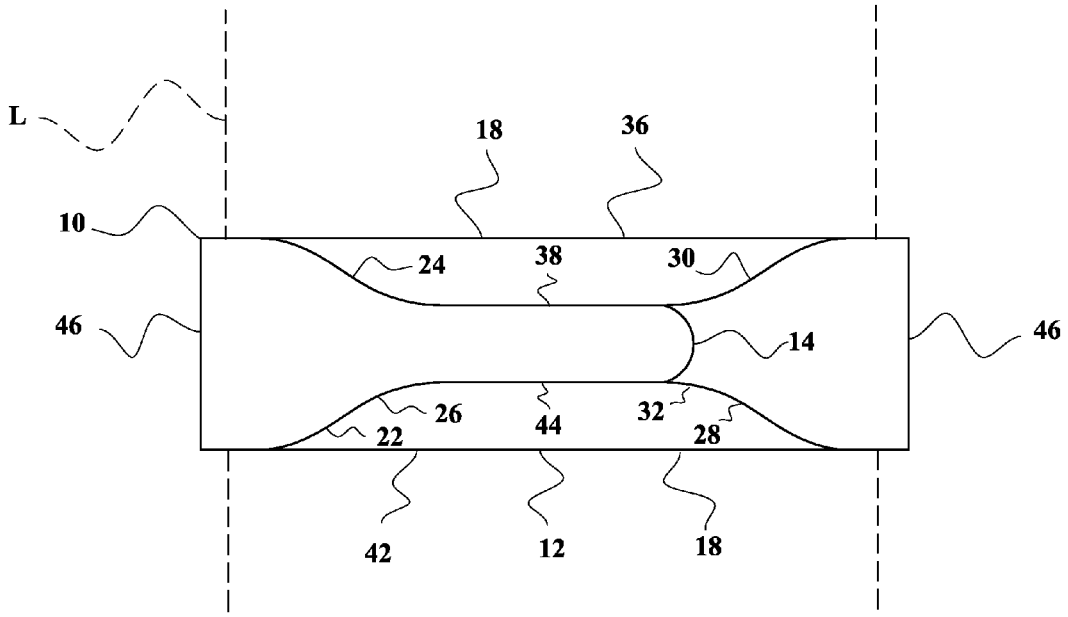
FIG. 4 is a front elevational view of the preferred embodiment of the invention in an closed position.
Figure 5:
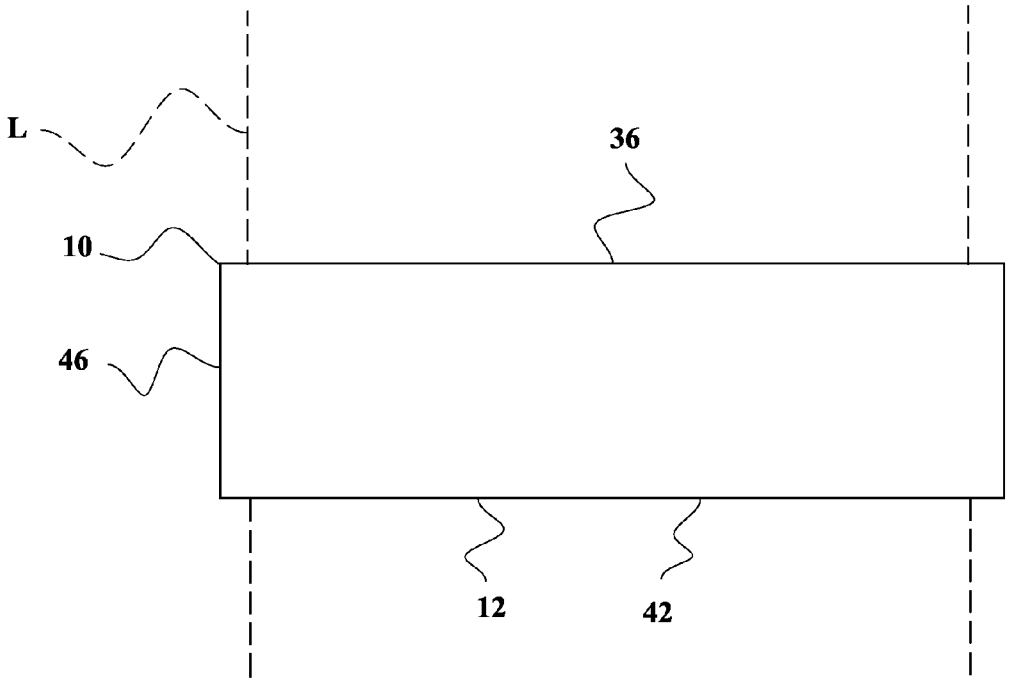
FIG. 5 is a rear elevational view of the preferred embodiment of the invention in an closed position.
Figure 6:
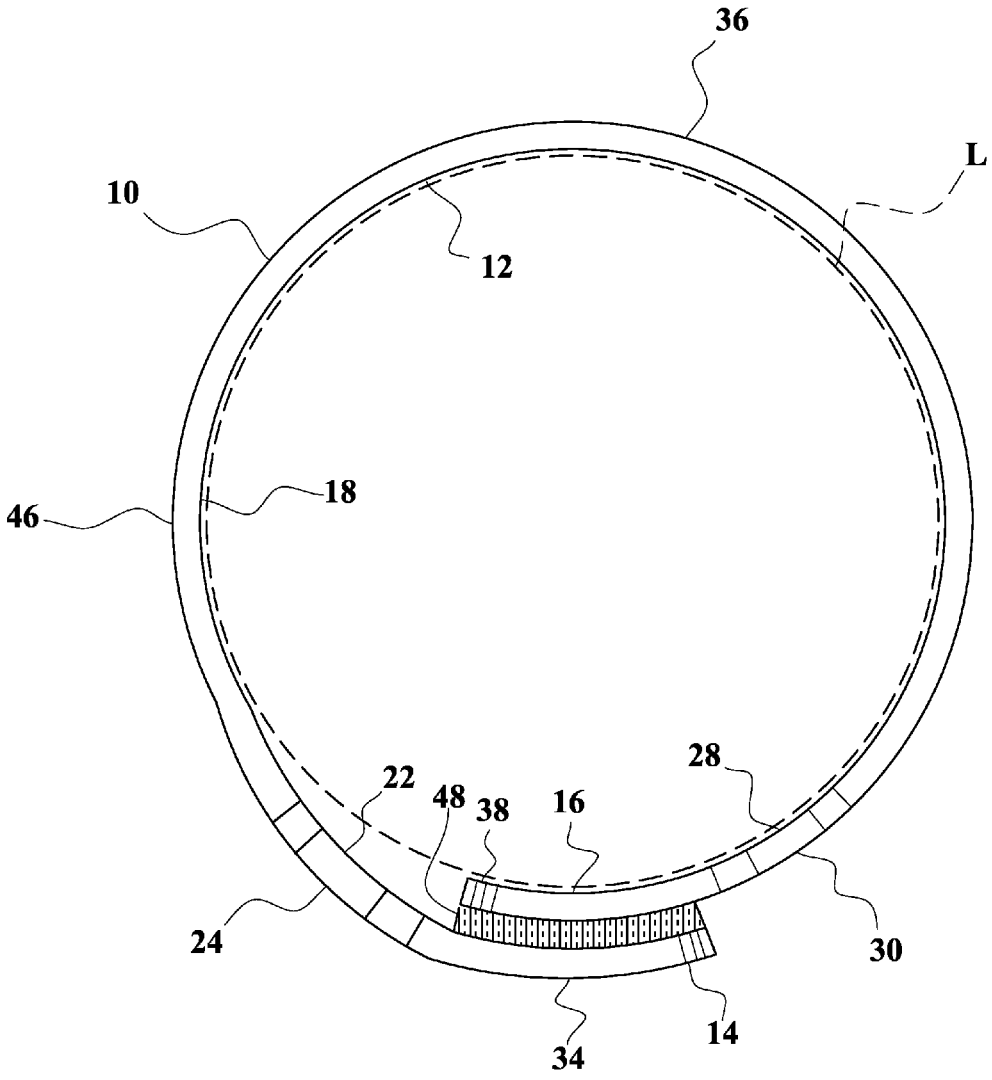
FIG. 6 is a top view of the preferred embodiment of the invention in an closed position.
Figure 7:
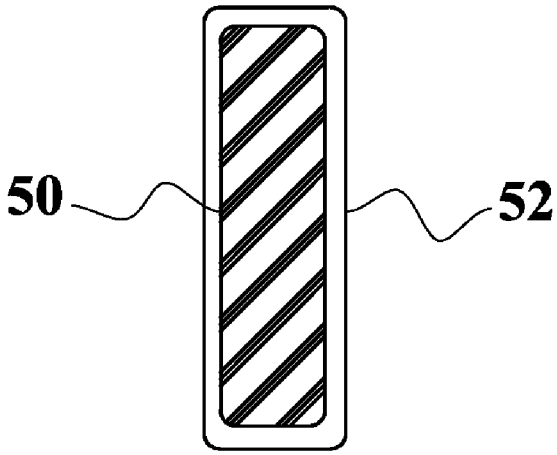
FIG. 7 is a section view along lines 7-7 in FIG. 1.

FIG. 4 is a front elevational view of the preferred embodiment of the invention in an closed position around a leg L, with the hook fasteners in one end section being engaging loops in the fabric in the other end section. FIG. 5 is a rear elevational view of the preferred embodiment of the invention in an closed position, showing the middle section covering the calf of the leg. FIG. 6 is a top view of the preferred embodiment of the invention in an closed position, showing the hook fasteners engaging loops in the fabric. FIG. 7 is a section view along lines 7-7 in FIG. 1, showing the flexible material 50 covered by the fabric 52.

While the drawings show the second end section having hook fasteners on its outer surface, other possibilities include: the second end section having hook fasteners on its inner surface, the first end section having hook fasteners on its inner surface, or the first end section having hook fasteners on its outer surface. The status of the surfaces as inner and outer may be reversed without permanently changing the apparatus, by engaging the hook fasteners on one end section in an opposite manner.

The flexible material that the inside of the single elongated strip is made from is preferably neoprene, but any suitable flexible material with similar shock-absorbing properties may be used. The fabric that covers the outside is preferably nylon, but any suitable fabric with loops that can be engaged by hook fasteners may be used.

The invention also encompasses a method of protecting the calves of rowers, or more generally of protecting the limbs of anyone, comprising the steps of obtaining an apparatus such as that described above, placing the middle section against the calf of a rower (or one side of the limb of any wearer), bringing the end sections around the front of the rower's leg (or the opposite side of the wearer's limb), pulling the end sections tight, and joining the hook fasteners on one end section to the loop fasteners on the other end section. Two of the single elongated strips may be used, one on each leg of the rower (or other wearer). A plurality of the single elongated strips may be used on the legs of a plurality of rowers in a boat. Alternatively, two of the single elongated strips may be used, one on each arm of the wearer.

It is to be understood that the present invention is not limited to the sole embodiment described above, but encompasses any and all embodiments within the scope of the following claims.

I claim:

1. A method of protecting the calves of rowers, comprising the steps of:

obtaining at least one single elongated flat strip of flexible impact absorbing material of uniform thickness without any holes, said strip being covered by a fabric, having an elongated wide middle section extending substantially a length of the strip, narrow tapered first and second end sections on opposite ends of said wide middle section, with the middle and first and second end sections each having an inner surface and an outer surface that integrally form the single strip, with the inner surface and the outer surface being parallel, with the first end section having hook fasteners extending from one surface that can be removably retained in loops in the fabric that covers the strip;

placing the middle section against a calf, between the knees and the ankles, of a rower;

bringing the end sections around the front of the rower's leg;

pulling the end sections tight; and joining the hook fasteners on the first end section to loops in the fabric covering the second end section, on the front portion of the rower's leg.

2. The method of protecting the calves of rowers according to claim 1, wherein two of the single elongated flat strips are used, one on each leg of the rower.

3. The method of protecting the calves of rowers according to claim 2, wherein a plurality of the single elongated flat strips are used on the legs of a plurality of rowers in a boat.

4. The method of protecting the calves of rowers according to claim 1, wherein the flexible material is neoprene, and the fabric that covers it is nylon.

5. The method of protecting the calves of rowers according to claim 1, wherein:

there are curved tapering portions between the first end section and the middle section, and between the middle section and the second end section;

the middle section and the first and second end sections each have upper and lower edges that are parallel;

the curved tapering portions between the first end section and the middle section, and between the middle section and the second end section, are symmetrical; and said curved tapering portions each have an upper edge and a lower edge that are symmetrical.

* * * * *